United States Patent [19]

Hasegawa

[11] Patent Number: 4,465,051

[45] Date of Patent: Aug. 14, 1984

[54] DEVICE FOR INTAKE AIR TEMPERATURE-DEPENDENT CORRECTION OF AIR/FUEL RATIO FOR INTERNAL COMBUSTION ENGINES

[75] Inventor: Shumpei Hasegawa, Niiza, Japan

[73] Assignee: Honda Motor Co., Ltd., Tokyo, Japan

[21] Appl. No.: 442,098

[22] Filed: Nov. 16, 1982

[30] Foreign Application Priority Data

Nov. 19, 1981 [JP] Japan ..... 56-185764

[51] Int. Cl.[3] ..... F02M 51/02

[52] U.S. Cl. ..... 123/486; 123/478

[58] Field of Search ..... 123/438, 440, 480, 486, 123/487, 421, 489

[56] References Cited

U.S. PATENT DOCUMENTS 4,245,604 1/1981 Lahiff ..... 123/480 X
4,313,412 2/1982 Hosaka et al. ..... 123/480
4,352,158 9/1982 Date et al. ..... 123/486 X
4,365,299 12/1982 Kondo et al. ..... 123/480 X

*Primary Examiner*—Tony M. Argenbright
*Attorney, Agent, or Firm*—Arthur L. Lessler

[57] ABSTRACT

A device for correcting the air/fuel ratio of a mixture being supplied to an internal combustion engine, by the use of a correction coefficient which has its value determined as a function of intake air temperature in the intake pipe of the engine, by a predetermined equation. Further, the air/fuel ratio may be corrected by the use of a second correction coefficient which has its value increasing as the intake air temperature decreases from a predetermined value. The above two correction coefficients have their values determined by means of arithmetic calculation, or by means of selective reading from a plurality of predetermined values stored in their respective memories, both based upon a detected value of the intake air temperature.

7 Claims, 12 Drawing Figures

| TA | TAi' | ---- | TA2' | TA1' | TAV0 | ---- | TA0 | ---- | TAj |
|---|---|---|---|---|---|---|---|---|---|
| KTA | KTAi' | ---- | KTA2' | KTA1' | ---- | ---- | KTA0 | ---- | KTAj |
| KTAV | KTAVi' | ---- | KTAV2' | KTAV1' | 1.0 | | | | |

DEVICE FOR INTAKE AIR TEMPERATURE-DEPENDENT CORRECTION OF AIR/FUEL RATIO FOR INTERNAL COMBUSTION ENGINES

BACKGROUND OF THE INVENTION

This invention relates to an air/fuel ratio correcting device for an internal combustion engine, which is adapted to correct the air/fuel ratio of an air/fuel mixture being supplied to the engine, depending upon the intake air temperature, so as to maintain the air/fuel ratio to a desired value.

A fuel supply control system adapted for use with an internal combustion engine, particularly a gasoline engine has been proposed e.g. by U.S. Ser. No. 348,648 assigned to the assignee of the present application, now U.S. Pat. No. 4,445,483, which is adapted to determine the valve opening period of a fuel injection device for control of the fuel injection quantity, i.e. the air/fuel ratio of an air/fuel mixture being supplied to the engine, by first determining a basic value of the above valve opening period as a function of engine rpm and intake pipe absolute pressure and then adding to and/or multiplying same by constants and/or coefficients being functions of engine rpm, intake pipe absolute pressure, engine temperature, throttle valve opening, exhaust gas ingredient concentration (oxygen concentration), etc., by electronic computing means.

In internal combustion engines, the density of the intake air varies with a change in the intake air temperature. This causes a change in the mass flow rate of the intake air even when there is no change in the volumetric flow rate of the intake air or in the absolute pressure in the intake pipe, leading to a change in the air/fuel ratio of the mixture being supplied to the engine. Further, the evaporation rate of fuel decreases with a decrease in the intake air temperature. Therefore, when the intake air temperature is low, the air/fuel ratio can be leaner than a desired value. In order to maintain the air/fuel ratio at values appropriate for operating conditions of the engine by means of the aforementioned fuel supply control system, it is necessary to correct the quantity of fuel being supplied to the engine in response to changes in the intake air temperature.

OBJECTS AND SUMMARY OF THE INVENTION

It is an object of the invention to provide a device for intake air temperature-dependent air/fuel ratio correction, which is adapted to correct the quantity of fuel being supplied to an internal combustion engine, in dependence upon the intake air temperature, so as to maintain the air/fuel ratio of the mixture at desired values, to thereby improve the operational stability and driveability of the engine.

It is another object of the invention to provide a device for intake air temperature-dependent air/fuel ratio correction, which is adapted to compensate for a decrease in the evaporation rate of fuel being supplied to the engine when the intake air temperature is low, to further improve the operational stability and driveability of the engine.

The present invention provides an air/fuel ratio correcting device forming part of a fuel supply control system which is adapted to determine a basic value of the air/fuel ratio of an air/fuel mixture being supplied to an internal combustion engine as a function of at least one parameter representing operating conditions of the engine. The air/fuel ratio correcting device comprises: an intake air temperature sensor for detecting a value of intake air temperature in the intake pipe of the engine; means for determining a value of a correction coefficient as a function of a value of the intake air temperature detected by the intake air temperature sensor; and means for correcting a determined basic value of the air/fuel ratio by an amount corresponding to a value of the correction coefficient determined by the above correction coefficient determining means. The correction coefficient determining means is adapted to determine the value of the correction coefficient by the following equation:

$$KTA = 1/[1 + CTA(TA - TAO)]$$

where TA represents a detected value (°C.) of intake air temperature, TAO a predetermined reference value (°C.) of intake air temperature, and CTA a constant whose value is determined by the engine associated with the air/fuel ratio correcting device.

Preferably, the air/fuel ratio correcting device further includes second correction coefficient determining means for determining a value of a second correction coefficient as a function of the detected value of the intake air temperature, and second correcting means for further correcting the determined basic value of the air/fuel ratio by an amount corresponding to a determined value of the second correction coefficient. The second correction coefficient is determined such that the determined value has a predetermined constant value when the intake air temperature has a value higher than a predetermined value which is lower than the aforementioned predetermined reference value TAO, and has its value increasing as the intake air temperature has its value decreasing from the above predetermined value. Also, the above two correction coefficients preferably have their values determined by means of calculating means for effecting arithmetic calculation based upon the detected value of the intake air temperature, or by means of memory means storing a plurality of predetermined values for the correction coefficients and means for selectively reading values from the memory means in accordance with the detected value of the intake air temperature.

Preferably, the fuel supply control system is adapted to determined a basic value of the valve opening period of at least one electromagnetically controlled fuel injection valve arranged for injecting fuel into the engine and having its valve opening period adapted to determine the quantity of fuel being supplied to the engine, as a function of at least one parameter representing operating conditions of the engine, to thereby control the air/fuel ratio of the mixture to desired values. The basic value of the valve opening period of the electromagnetically controlled fuel injection valve is corrected by the determined values of the above two correction coefficients.

The above and other objects, features and advantages of the invention will be more apparent from the ensuing detailed description taken in connection with the accompanying drawings.

BRIEF DESCRIPTION OF THE DRAWINGS

FIG. 6 is a graph showing the relationship between the intake air temperature and the evaporation quantity of fuel droplets, obtained at the termination of a certain period of time to;

DETAILED DESCRIPTION

The air/fuel ratio correcting device according to the present invention will now be described in detail with reference to the drawings.

Figure 1:
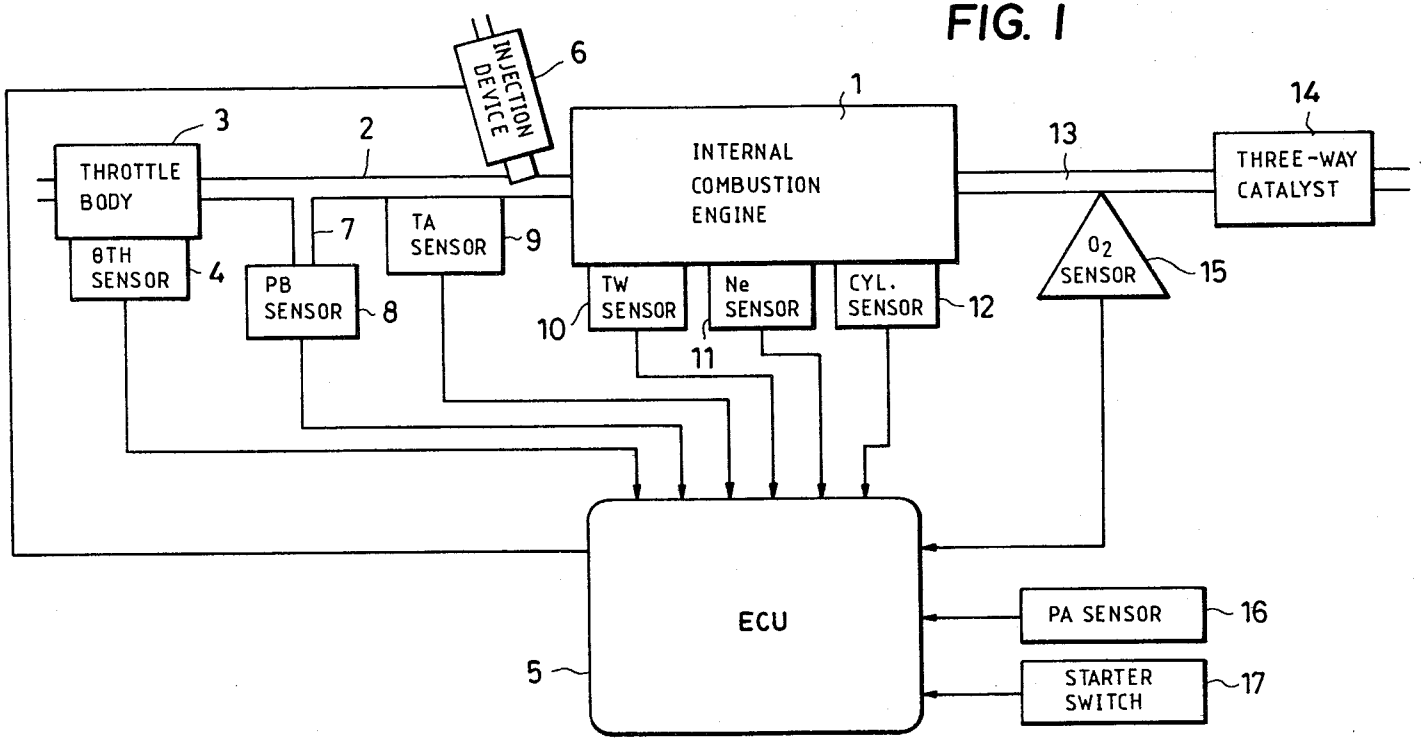
FIG. 1 is a block diagram illustrating a fuel supply control system inclusive of an air/fuel ratio correcting device according to the present invention.

Referring first to FIG. 1, there is illustrated the whole arrangement of a fuel injection control system for internal combustion engines, inclusive of the air/fuel ratio correcting device according to the present invention. Reference numeral 1 designates an internal combustion engine which may be a four-cylinder type, for instance. This engine 1 has main combustion chambers which may be four in number and sub combustion chambers communicating with the main combustion chambers, none of which is shown. An intake pipe 2 is connected to the engine 1, which comprises a main intake pipe communicating with each main combustion chamber, and a sub intake pipe with each sub combustion chamber, respectively, neither of which is shown. Arranged across the intake pipe 2 is a throttle body 3 which accommodates a main throttle valve and a sub throttle valve mounted in the main intake pipe and the sub intake pipe, respectively, for synchronous operation. Neither of the two throttle valves is shown. A throttle valve opening sensor 4 is connected to the main throttle valve for detecting its valve opening and converting same into an electrical signal which is supplied to an electronic control unit (hereinafter called "ECU") 5.

A fuel injection device 6 is arranged in the intake pipe 2 at a location between the engine 1 and the throttle body 3, which comprises main injectors and a subinjector, all formed by electromagnetically operated fuel injection valves, none of which is shown in FIG. 1. The main injectors correspond in number to the engine cylinders and are each arranged in the main intake pipe at a location slightly upstream of an intake valve, not shown, of a corresponding engine cylinder, while the subinjector, which is single in number, is arranged in the sub intake pipe at a location slightly downstream of the sub throttle valve, for supplying fuel to all the engine cylinders. The fuel injection device 6 is connected to a fuel pump, not shown. The main injectors and the subinjector are electrically connected to the ECU 5 in a manner having their valve opening periods or fuel injection quantities controlled by driving signals supplied from the ECU 5.

On the other hand, an absolute pressure sensor 8 communicates through a conduit 7 with the interior of the main intake pipe at a location immediately downstream of the main throttle valve of the throttle body 3. The absolute pressure sensor 8 is adapted to detect absolute pressure in the intake pipe 2 and apply an electrical signal indicative of detected absolute pressure to the ECU 5. An intake air temperature sensor 9 is arranged in the intake pipe 2 at a location downstream of the absolute pressure sensor 8 and also electrically connected to the ECU 5 for supplying thereto an electrical signal indicative of detected intake air temperature.

An engine temperature sensor 10, which may be formed of a thermistor or the like, is mounted on the main body of the engine 1 in a manner embedded in the peripheral wall of an engine cylinder having its interior filled with cooling water, an electrical output signal of which is supplied to the ECU 5.

An engine rpm sensor (hereinafter called "Ne sensor") 11 and a cylinder-discriminating sensor 12 are arranged in facing relation to a camshaft, not shown, of the engine 1 or a crankshaft of same, not shown. The former 11 is adapted to generate one pulse at a particular crank angle each time the engine crankshaft rotates through 180 degrees, i.e., a pulse of the top-dead-center position (TDC) signal, while the latter is adapted to generate one pulse at a particular crank angle of a particular engine cylinder. The above pulses generated by the sensors 11, 12 are supplied to the ECU 5.

A three-way catalyst 14 is arranged in an exhaust pipe 13 extending from the main body of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen in the exhaust gases and supplying an electrical signal indicative of a detected concentration value to the ECU 5.

Further connected to the ECU 5 are a sensor 16 for detecting atmospheric pressure and a starting switch 17 of the engine, respectively, for supplying an electrical signal indicative of detected atmospheric pressure and an electrical signal indicative of its own on and off positions to the ECU 5.

Next, details of the manner of air/fuel ratio control of the fuel supply control system outlined above will now be described with reference to FIG. 1 referred to above as well as FIGS. 2 through 12.

Figure 2:
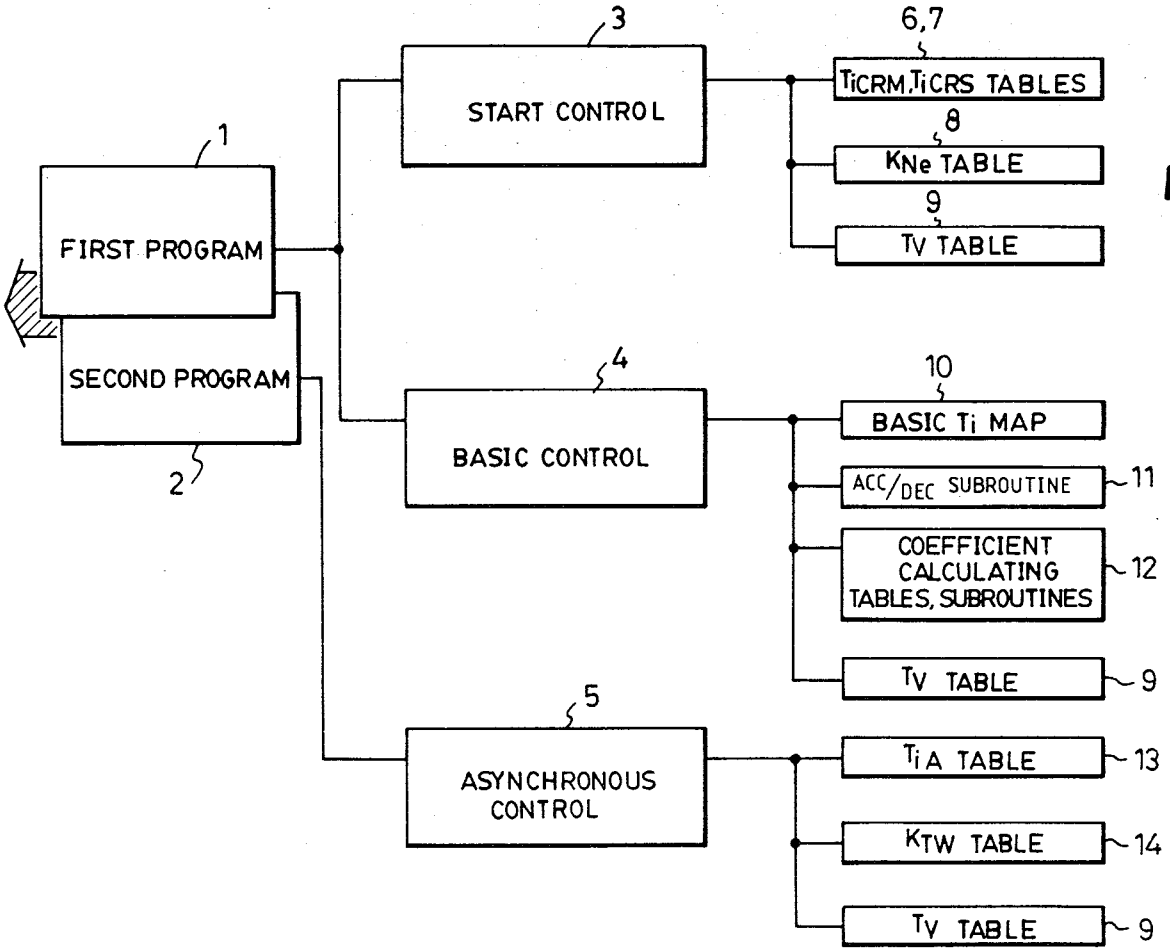
FIG. 2 is a block diagram illustrating a program for control of the valve opening periods TOUTM and TOUTS of the main injectors and the subinjector, which is incorporated in the electronic control unit (ECU) in FIG. 1.

FIG. 2 shows a block diagram showing the whole program for air/fuel ratio control, i.e., control of the valve opening periods TOUTM and TOUTS of the main injectors and the subinjector, which is executed by the ECU 5. The program comprises a first program 1 and a second program 2. The first program 1 is used for fuel quantity control in synchronism with the TDC signal, hereinafter merely called "synchronous control" unless otherwise specified, and comprises a start control subroutine 3 and a basic control subroutine 4, while the second program 2 comprises an asynchronous control subroutine 5 which is carried out in asynchronism with or independently of the TDC signal.

In the start control subroutine 3, the valve opening periods TOUTM and TOUTS are determined by the following basic equations:

$$TOUTM = TiCRM \times KNe + (TV + \Delta TV) \quad (1)$$

$$TOUTS = TiCRS \times KNe + TV \quad (2)$$

where TiCRM and TiCRS represent basic values of the valve opening periods for the main injectors and the subinjector, respectively, which are determined from a TiCRM table 6 and a TiCRS table 7, respectively, KNe represents a correction coefficient applicable at the start of the engine, which is variable as a function of engine rpm Ne and determined from a KNe table 8, and TV represents a constant for increasing and decreasing the valve opening period in response to changes in the output voltage of the battery, which is determined from a TV table 9. ΔTV is added to TV applicable to the main injectors as distinct from TV applicable to the subinjector, because the main injectors are structurally different from the subinjector and therefore have different operating characteristics.

The basic equations for determining the values of TOUTM and TOUTS applicable to the basic control subroutine 4 are as follows:

$$TOUTM = (TiM - TDEC) \times (KTA \times KTAV \times KTW \times KAFC \times KPA \times KAST \times KWOT \times KO_2 \times KLS) + TACC \times (KTA \times KTWT \times KAFC) + (TV + \Delta TV) \quad (3)$$

$$TOUTS = (TiS - TDEC) \times (KTA \times KTAV \times KTW \times KAST \times KPA) + TV \quad (4)$$

where TiM and TiS represent basic values of the valve opening periods for the main injectors and the subinjector, respectively, and can be determined from a basic Ti map 10, and TDEC and TACC represent constants applicable, respectively, at engine deceleration and at engine acceleration and are determined by acceleration and decceleration subroutines 11. The coefficients KTA, KTAV, KTW, etc. are determined by their respective tables and/or subroutines 12. KTA and KTAV are intake air temperature-dependent correction coefficients and are determined from a table as a function of actual intake air temperature, details of which will be described later, KTW a fuel increasing coefficient which is determined from a table as a function of actual engine cooling water temperature TW, KAFC a fuel increasing coefficient applicable after fuel cut operation and determined by a subroutine, KPA an atmospheric pressure-dependent correction coefficient determined from a table as a function of actual atmospheric pressure, and KAST a fuel increasing coefficient applicable after the start of the engine and determined by a subroutine. KWOT is a coefficient for enriching the air/fuel mixture, which is applicable at wide-open-throttle and has a constant value, $K0_2$ an "$0_2$ feedback control" correction coefficient determined by a sub-routine as a function of actual oxygen concentration in the exhaust gases, and KLS a mixture-leaning coefficient applicable at "lean stoich." operation and having a constant value. The term "stoich." is an abbreviation of a word "stoichiometric" and means a stoichiometric or theoretical air/fuel ratio of the mixture.

On the other hand, the valve opening period TMA for the main injectors which is applicable in asynchronism with the TDC signal is determined by the following equation:

$$TMA = TiA \times KTWT \times KAST + (TV + \Delta TV) \quad (5)$$

where TiA represents a TDC signal-asynchronous fuel increasing basic value applicable at engine acceleration and in asynchronism with the TDC signal. This TiA value is determined from a TiA table 13. KTWT is defined as a fuel increasing coefficient applicable at and after TDC signal-synchronous acceleration control as well as at TDC signal-asynchronous acceleration control, and is calculated from a value of the aforementioned water temperature-dependent fuel increasing coefficient KTW obtained from the table 14.

Figure 3:
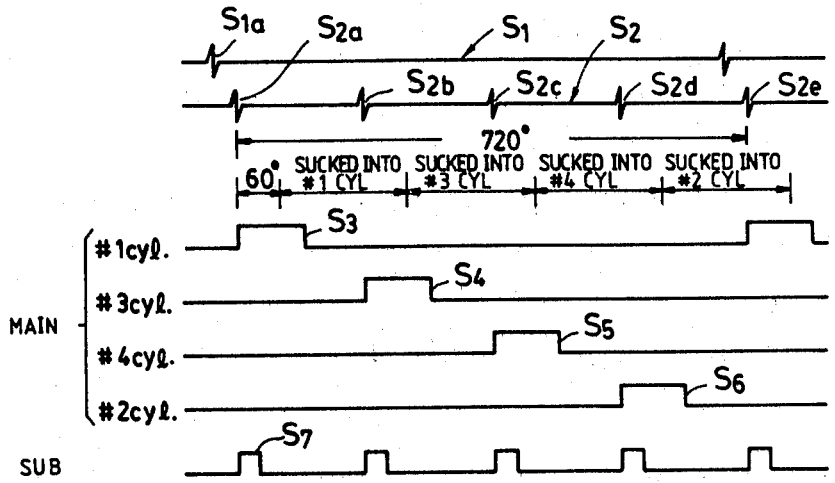
FIG. 3 is a timing chart showing the relationship between a cylinder-discriminating signal and a top-dead-center (TDC) signal inputted to the ECU, and driving signals for the main injectors and the subinjector, outputted from the ECU.

FIG. 3 is a timing chart showing the relationship between the cylinder-discriminating signal and the TDC signal, both inputted to the ECU 5, and the driving signals outputted from the ECU 5 for driving the main injectors and the subinjector. The cylinder-discriminating signal $S_1$ is inputted to the ECU 5 in the form of a pulse $S_1$ a each time the engine crankshaft rotates through 720 degrees. Pulses $S_2a$–$S_2e$ forming the TDC signal $S_2$ are each inputted to the ECU 5 each time the engine crankshaft rotates through 180 degrees. The relationship in timing between the two signals $S_1$, $S_2$ determines the output timing of driving signals $S_3$–$S_6$ for driving the main injectors of the four engine cylinders. More specifically, the driving signal $S_3$ is outputted for driving the main injector of the first engine cylinder, concurrently with the first TDC signal pulse $S_2a$, the driving signal $S_4$ for the third engine cylinder concurrently with the second TDC signal pulse $S_2b$, the driving signal $S_5$ for the fourth cylinder concurrently with the third pulse $S_2c$, and the driving signal $S_6$ for the second cylinder concurrently with the fourth pulse $S_2d$, respectively. The subinjector driving signal $S_7$ is generated in the form of a pulse upon application of each pulse of the TDC signal to the ECU 5, that is, each time the crankshaft rotates through 180 degrees. It is so arranged that the pulses $S_2a$, $S_2b$, etc. of the TDC signal are each generated earlier by 60 degrees than the time when the piston in an associated engine cylinder reaches its top dead center, so as to compensate for arithmetic operation lag in the ECU 5, and a time lag between the formation of a mixture and the suction of the mixture into the engine cylinder, which depends upon the opening action of the intake pipe before the piston reaches its top dead center and the operation of the associated injector.

Figure 4:
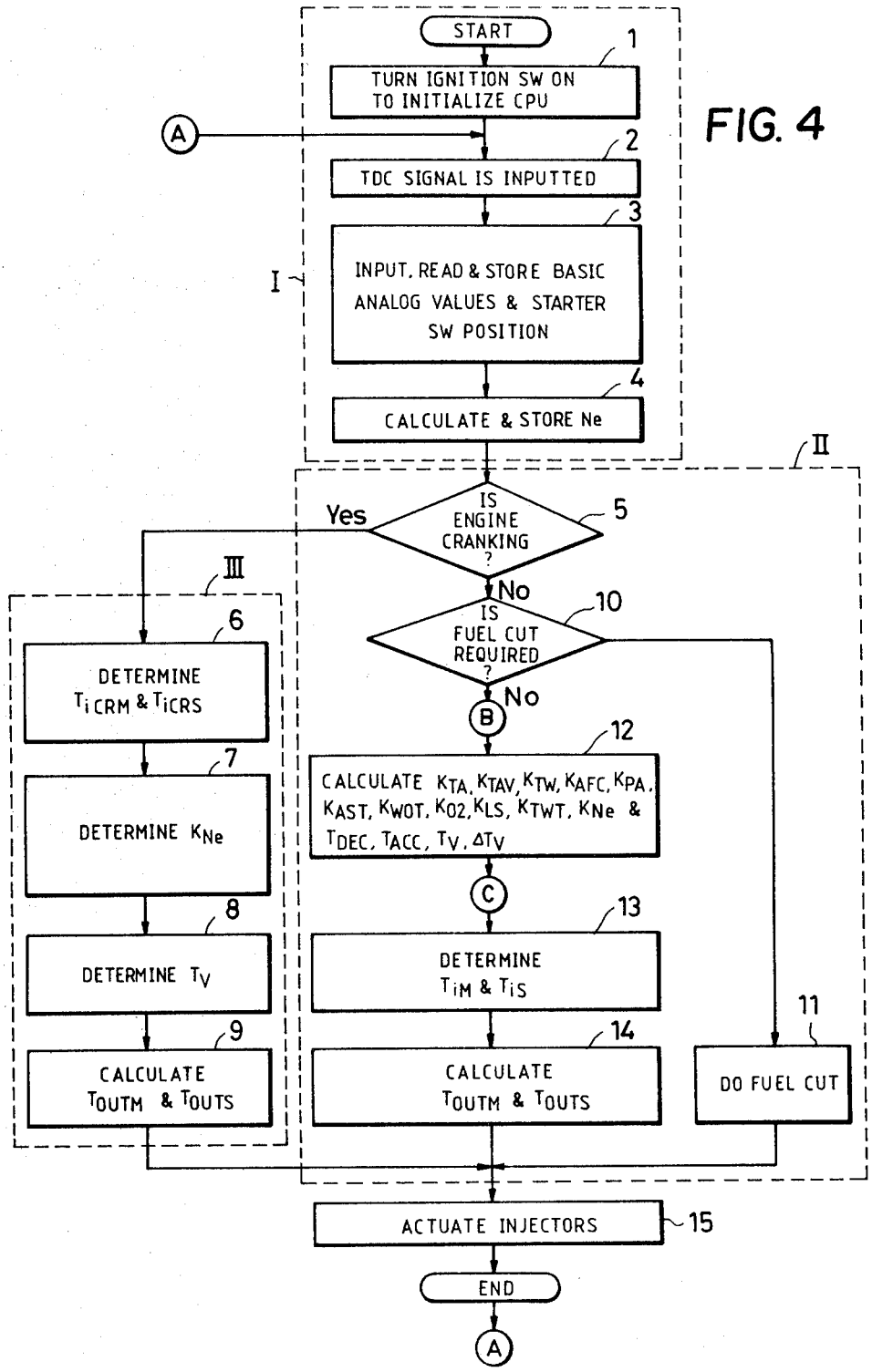
FIG. 4 is a flow chart showing a main program for control of the valve opening periods TOUTM and TOUTS.

Referring next to FIG. 4, there is shown a flow chart of the aforementioned first program 1 for control of the valve opening period in synchronism with the TDC signal in the ECU 5. The whole program comprises an input signal processing block I, a basic control block II and a start control block III. First in the input processing block I, when the ignition switch of the engine is turned on, a CPU in the ECU 5 is initialized at the step 1 and the TDC signal is inputted to the ECU 5 as the engine starts at the step 2. Then, all basic analog values are inputted to the ECU 5, which include detected values of atmospheric pressure PA, absolute pressure PB, engine cooling water temperature TW, atmospheric air temperature TA, throttle valve opening $\theta$th, battery voltage V, output voltage value V of the $O_2$ sensor and on-off state of the starting switch 17, some necessary ones of which are then stored therein (step 3). Further, the period between a pulse of the TDC signal and the next pulse of same is counted to calculate actual engine rpm Ne on the basis of the counted value, and the calculated value is stored in the ECU 5 (step 4). The program then proceeds to the basic control block II. In this block, a determination is made, using the calculated Ne value, as to whether or not the engine rpm is smaller than the cranking rpm (starting rpm) at the step 5. If the answer is affirmative, the program proceeds to the start control subroutine III. In this block, values of TiCRM and TiCRS are selected from a TiCRM table and a TiCRS table, respectively, on the basis of the detected value of engine cooling water temperature TW (step 6). Also, the value of Ne-dependent correction coefficient KNe is determined by using the KNe table (step 7). Further, the value of battery voltage-dependent correction constant TV is determined by using the TV table (step 8). These determined values are applied to the aforementioned equations (1), (2) to calculate the values of TOUTM and TOUTS (step 9).

If the answer to the question of the above step 5 is no, it is determined whether or not the engine is in a condition for carrying out fuel cut, at the step 10. If the answer is yes, the values of TOUTM and TOUTS are both set to zero, at the step 11.

On the other hand, if the answer to the question of the step 10 is negative, calculations are carried out of values of correction coefficients KTA, KTAV, KTW, KAFC, KPA, KAST, KWOT, $K0_2$, KLS, KTWT, etc. and values of correction constants TDEC, TACC, TV and $\Delta$TV, by means of the respective calculation subroutines and tables, at the step 12.

Then, basic valve opening period values TiM and TiS are selected from respective maps of the TiM value and the TiS value, which correspond to data of actual engine rpm Ne and actual absolute pressure PB and/or like parameters, at the step 13.

Then, calculations are carried out of the values TOUTM and TOUTS on the basis of the values of correction coefficients, correction constants and basic valve opening periods determined at the steps 12 and 13, as described above, using the aforementioned equations (3), (4) (step 14). The main injectors and the subinjector are actuated with valve opening periods corresponding to the values of TOUTM and TOUTS obtained by the aforementioned steps 9, 11 and 14 (step 15).

As previously stated, in addition to the above-described control of the valve opening periods of the main injectors and the subinjector in synchronism with the TDC signal, asynchronous control of the valve opening periods of the main injectors is carried out in a manner asynchronous with the TDC signal but synchronous with a certain pulse signal having a constant pulse repetition period, detailed description of which is omitted here.

Reference is now made to the intake air temperature-dependent correction coefficients KTA and KTAV. When there occurs a change in the intake air temperature, there occurs a corresponding change in the density or specific gravity of the intake air, which causes a change in the mass flow rate of the intake air even when there is no change in the volumetric flow rate or quantity of flow air of the intake air or in the intake pipe absolute pressure PB. The intake air temperature TA and the specific gravity $\gamma$ air of the intake air are in the relationship of $\gamma \text{ air} \propto 1/(TA+273)$, and therefore, the value of the intake air temperature-dependent correction coefficient KTA can be given from the relationship of $KTA \propto 1/(TA+273)$. Taking into account the engine, e.g. the type of the engine, to which the present air/fuel ratio correcting device is to be applied, the following equation has been experimentally obtained for determining the value of the correction coefficient KTA:

$$KTA=1/[1+CTA(TA-TAO)] \quad (6)$$

where,

TA: actual intake air temperature (°C.);

TAO: predetermined reference intake air temperature (°C.); and

CTA: a constant whose value is determined by the engine associated with the present air/fuel ratio correcting device.

According to the present invention, the air/fuel ratio correction dependent upon intake air temperature is intended to be effected after warming-up of the engine, and therefore, the predetermined reference intake air temperature is set at a value falling within a range from 35 to 50° C., for instance.

In place of the equation (6), the following equation may be used, if the constant value CTA is set at a small value:

$$KTA=1-CTA(TA-TAO) \quad (6)'$$

Even by this alternative equation (6)', the value KTA can be determined with high accuracy, while permitting simplification of the processing within the ECU.

Figure 5:
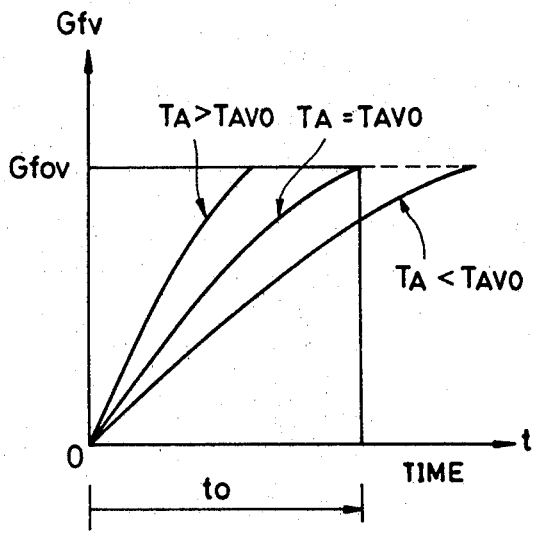
FIG. 5 is a graph showing the relationship between the intake air temperature and the evaporation quantity of fuel droplets, plotted with respect to time.

When the intake air temperature is low, there can occur the phenomenon that the mixture has a leaner air/fuel ratio than a required value due to a reduction in the evaporation rate of fuel, besides a change in the air/fuel ratio due to a change in the density of the intake air, described above. FIG. 5 shows the evaporation quantity of injected fuel. It will be noted from FIG. 5 that the evaporation quantity increases with a lapse of time from injection. In FIG. 5, the gravity or weight of evaporated fuel required for stable engine operation is designated by Gfov, the gravity or weight of injected fuel Gf, and the period of time to between injection and ignition, respectively. If fuel having a quantity Gf is all evaporated within the period of time to, a quantity of fuel equal to the weight Gfov has only to be injected, whereas if it is not all evaporated within the period of time to, the fuel injection quantity has to be increased by an amount corresponding to the amount not evaporated.

The evaporation rate X of fuel droplets per unit time is variable as a function of the total surface area of the fuel droplets, determined by the droplet diameter, and the ambient temperature TA, provided that the injected fuel quantity is constant per unit time. Further, so long as fuel is injected at a constant rate through the same injector or injectors, it can be regarded that the total surface area of the injected fuel droplets remains substantially constant, and therefore, the evaporation rate X is a function of the ambient temperature TA alone. If the gravity of evaporated fuel at the termination of the period of time to is designated by Gfv, the evaporation gravity Gfv can be expressed as follows:

$$Gfv = Gf \times X \times to \quad (7)$$

If a fuel injection quantity or gravity required when the intake air temperature TA is equal to a predetermined reference temperature TAVO is designated by Gfo, this injection quantity Gfo should be set at such a value that the evaporation quantity at the termination of the period of time to is equal to the required amount Gfov, when the intake air temperature TA is equal to the reference temperature TAVO. That is, if the evaporation rate of fuel at the reference intake air temperature TAVO is designated by Xo, the evaporation gravity Gfv per period of time to is expressed as follows:

$$Gfv = Gfov \times Xo \times to$$

When the actual intake air temperature TA is lower than the reference temperature TAVO (TA<TAVO), the evaporation rate X is low. Therefore, if the injection or gravity quantity is equal to the gravity Gfo required at the reference temperature TAVO, the evaporation gravity does not reach the quantity Gfov at the termination of the period of time to. That is, the following relationship stands:

$$Gfo \times XL \times to < Gfov$$

where XL is smaller than Xo.

Therefore, the quantity of fuel being supplied to the engine has to be increased so as to make up for the short evaporation quantity and thereby make the evaporation quantity at the termination of the period of time to equal to the value Gfov. To this end, the correction coefficient KTAV is used so as to satisfy the following equation:

$$KTAV \times Gfo \times XL \times to = Gfov$$

where KTAV should have a value larger than 1.

Figure 6:
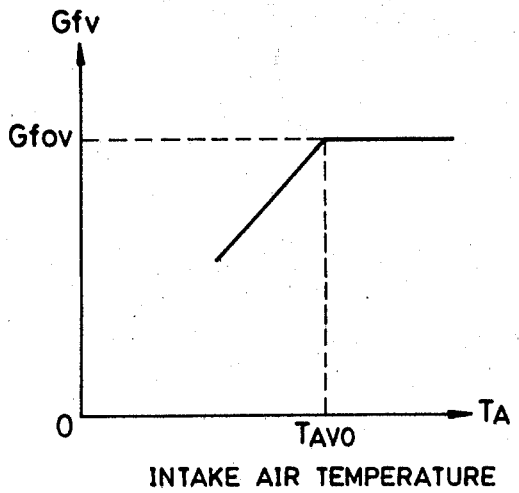
Figure 7:
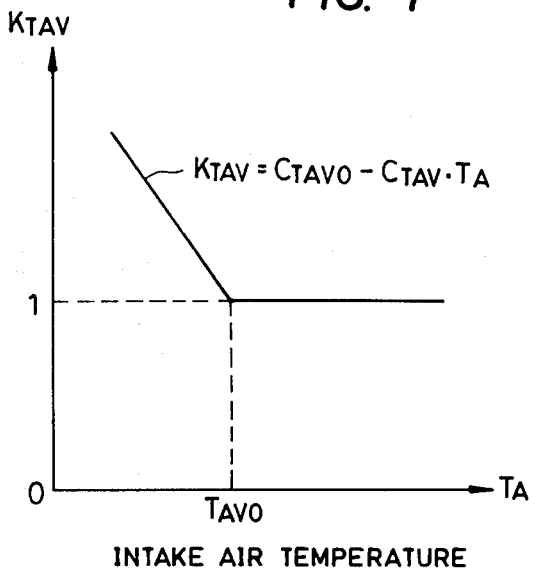
FIG. 7 is a graph showing the relationship between the intake air temperature and the value of an intake air temperature-dependent correction coefficient KTAV.

On the other hand, when the actual intake air temperature TA is higher than the reference temperature TAVO (TA<TAVO), the evaporation rate X is larger than Xo, so that evaporation of all the injected fuel is completed by the termination of the period of time to, to obtain an evaporation quantity equal to the value Gfov. That is, when the relationship of TA<TAVO is fulfilled, a fuel quantity equal to the value Gfo suffices for the engine, requiring neither fuel increase nor fuel decrease. On this occasion, the correction coefficient KTAV should be set to 1. The above reference temperature TAVO is set at a value equal to an intake air temperature at which fuel injected into the intake pipe can be completely evaporated within a period of time between the injection of the fuel and the ignition of same. For instance, it can be set at a value within a range from 0° to 20° C. Since this reference temperature TAVO is lower than the aforementioned reference temperature TAO, correction based upon the coefficient KTAV is always accompanied by correction based upon the other coefficient KTA. FIG. 6 shows how the evaporation quantity Gfv at the termination of the period of time to varies depending upon a change in the intake air temperature TA, provided that the fuel injection quantity is equal to the value Gfo (constant). FIG. 7 shows how the value of the correction coefficient KTAV should be set, depending upon the change of the intake air temperature, in accordance with the above given consideration.

Figure 9:
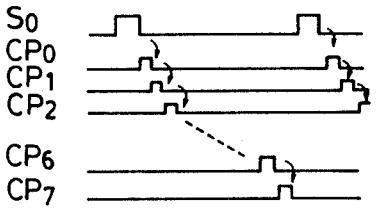
FIG. 9 is a timing chart showing the relationship between TDC pulses SO inputted to the sequential clock generator in FIG. 8 and clock pulses generated from the same generator.
Figure 8:
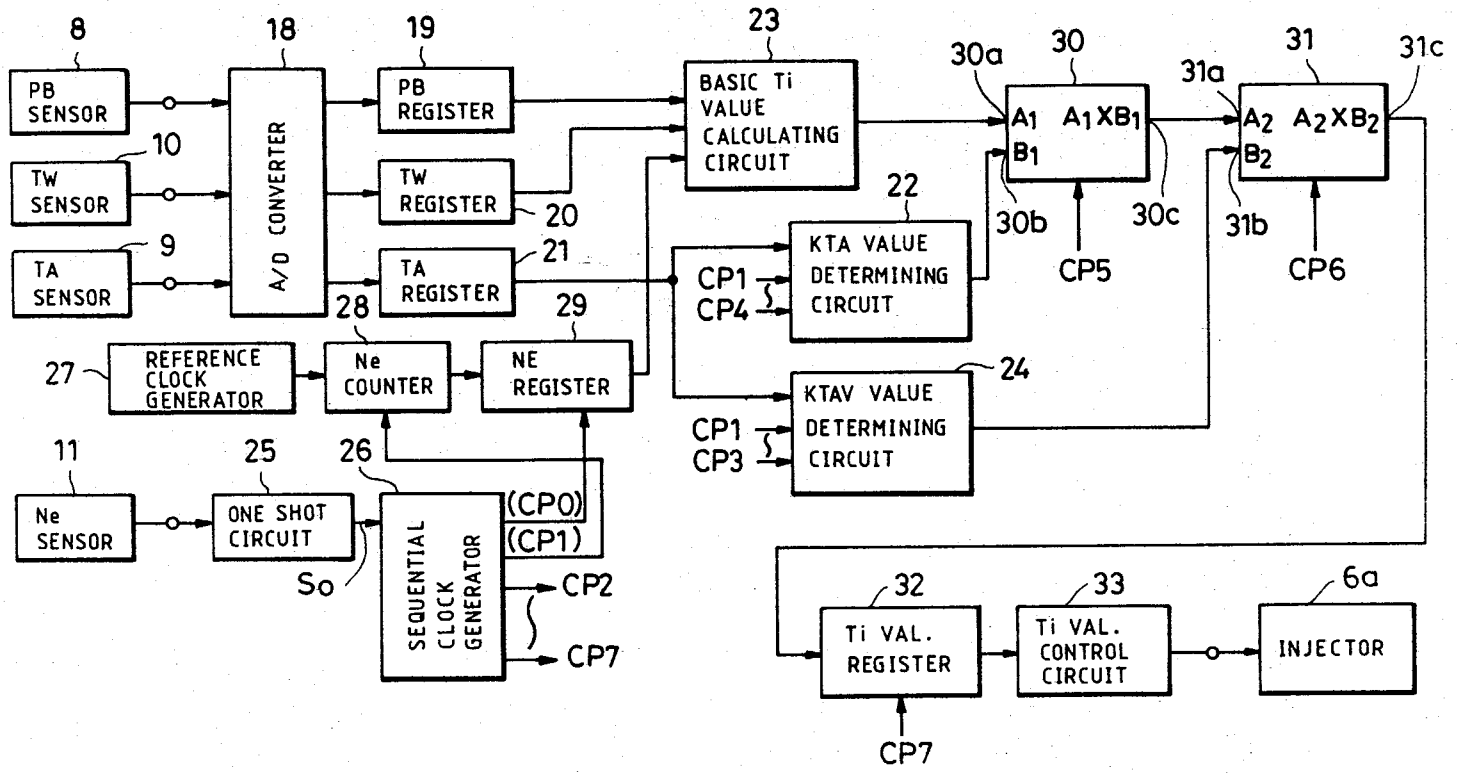
FIG. 8 is a block diagram illustraing the interior arrangement of the ECU.
Figure 10:
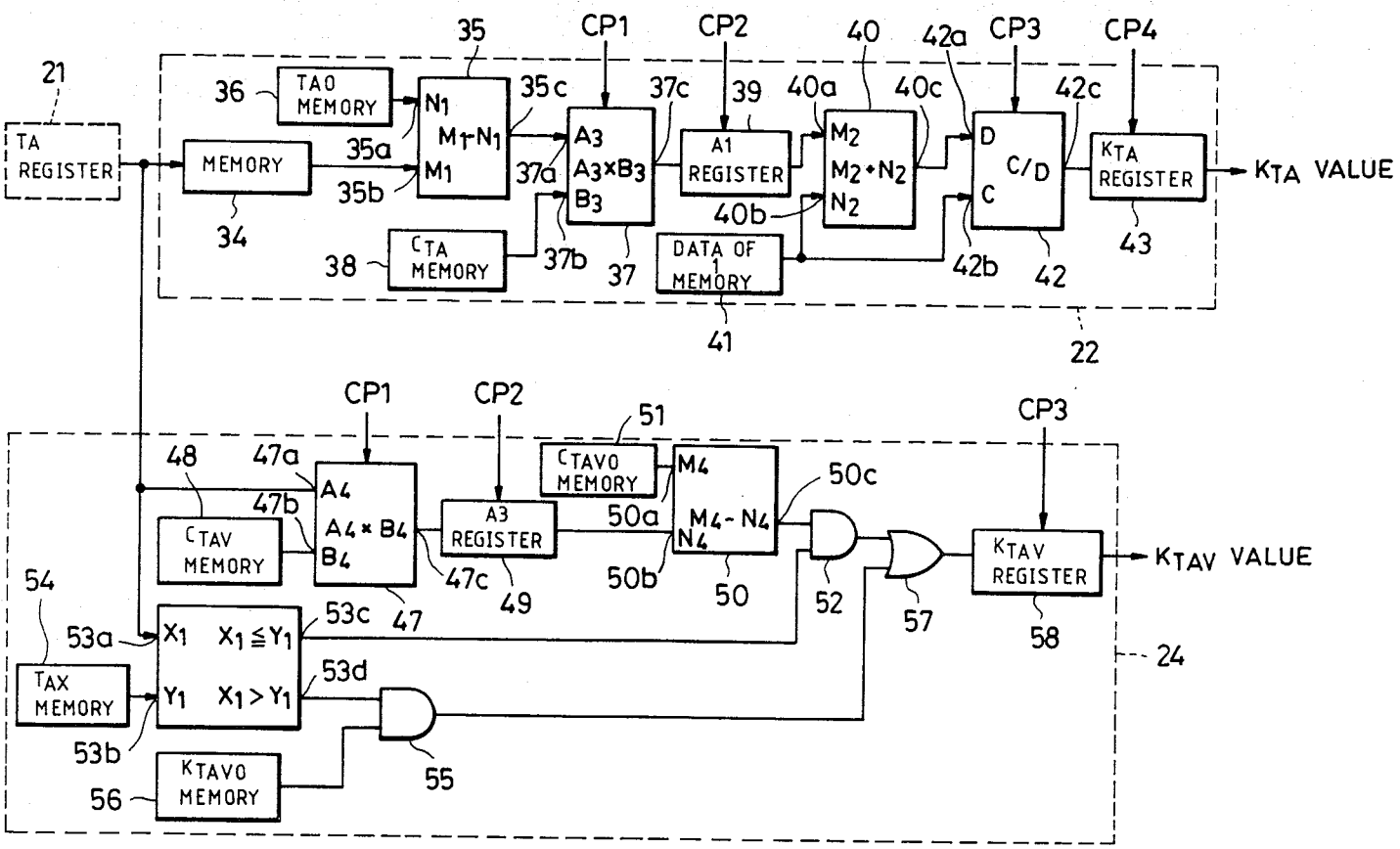
FIG. 10 is a circuit diagram illustrating an embodiment of the interior arrangements of the KTA value determining circuit and the KTAV value determining circuit, both appearing in FIG. 8.

FIGS. 8 through 10 illustrate the interior construction of the ECU 5 used in the fuel supply control system described above, showing in particular detail the sections for determining the values of the intake air temperature-dependent correction coefficients KTA and KTAV.

Referring first to FIG. 8, there is illustrated the whole internal arrangement of the ECU 5. The intake pipe absolute pressure PB sensor 8, the engine water temperature TW sensor 10 and the intake air temperature TA sensor 9, all appearing in FIG. 1, are connected, respectively, to a PB value register 19, a TW value register 20 and a TA value register 21, by way of an A/D converter unit 18. The engine rpm Ne sensor 11 is connected to the input of a sequential clock generator 26 by way of a one shot circuit 25, and the clock generator 26 has its output connected to the inputs of an Ne value counter 28, an NE value register 29, a KTA value determining circuit 22 and a KTAV value determining circuit 24. A reference clock generator 27 is connected to the Ne value counter 28 which in turn is connected to the NE value register 29. Thus, these three circuits are serially connected in the order mentioned. The PB value register 19, the TW value register 20 and the NE value register 29 have their outputs connected to the input of a basic Ti value calculating circuit 23 which in turn has its output connected to an input terminal **30*a* of a multiplier 30. The TA value register 21 has its output connected to the inputs of the KTA value determining circuit 22 and the KTAV value determining circuit 24. The KTA value determining circuit 22 has its output connected to another input terminal 30*b* of the multiplier 30, while the KTAV value determining circuit 24 has its output connected to an input terminal 31*b* of another multiplier 31. The multiplier 30 has its output terminal 30*c* connected to another input terminal 31*a* of the multiplier 31, which in turn has its output terminal 31*c* connected to a fuel injection valve or valves 6*a* of the fuel injection device 6 shown in FIG. 1, by way of a Ti value register 32 and a Ti value control circuit 33**.

The engine rpm Ne sensor 11 supplies a TDC signal to the one shot circuit 25, which forms a waveform shaping circuit in cooperation with the sequential clock generator 26 adjacent thereto. The one shot circuit 25 generates an output pulse So each time a pulse of the TDC signal is applied thereto, and the pulse So is applied to the sequential clock generator 26 to actuate same to generate clock pulses CPO - 7, in a sequential manner as shown in FIG. 9. The first clock pulse CPO is supplied to the NE value register 29 to cause a count from the Ne value counter 28 to be loaded thereinto. The counter 28 permanently counts reference clock pulses supplied from the reference clock generator 27. Then, the second clock pulse CP1 is supplied to the Ne value counter 28 to reset its count to zero. Therefore, the engine rpm Ne is measured in between two adjacent pulses of the TDC signal, and the measured value NE is stored into the NE value register 29. Further, the clock pulses CP1 - 3 are supplied to the KTAV value determining circuit 24, and the clock pulses CP1 - 4 to the KTA value determining circuit 22, respectively. Also, the clock pulses CP5, CP6 and CP7 are supplied to the multiplier 30, the multiplier 31 and the Ti value register 32, respectively.

The output signals of the absolute pressure PB sensor 8, the water temperature TW sensor 10 and the intake air temperature TA sensor 9 are converted into respective corresponding digital signals by the A/D converter unit 18, and then these digital signals are loaded into the PB value register 19, the TW value register 20 and the TA value register 21, respectively. The basic Ti value calculating circuit 23 operates to calculate a basic valve opening period Ti for the fuel injection valve or valves in the manner previously described with reference to FIGS. 2 through 4, in response to input data indicative of actual intake pipe absolute pressure PB, actual engine water temperature TW and actual engine rpm Ne, supplied from the PB value register 19, the TW value register 20 and the NE value register 29, respectively. The calculated Ti value is supplied to the input terminal 30*a* of the multiplier 30 as an input A1.

The KTA value determining circuit 22 operates on input data indicative of actual intake air temperature TA, supplied from the TA value register 21 to determine a value of the intake air temperature-dependent correction coefficient KTA, using the aforesaid equation (6). The determined KTA value is applied to the other input terminal 30*b* of the multiplier 30 as an input B1. The multiplier 30 carries out a multiplication of the input A1 by the input B1, upon application of each clock pulse CP6 applied thereto, to obtain a product of the calculated basic Ti value and the determined value of the correction coefficient KTA, and the product KTA×Ti is applied to the input terminal 31*a* of the multiplier 31 as an input A2.

On the other hand, the KTAV value determining circuit 24 operates on input data indicative of actual intake air temperature TA, supplied from the TA value register 21, to determine a value of the other intake air temperature-dependent correction coefficient KTAV in the manner shown in FIG. 7. The determined KTAV value is applied to the other input terminal 31*b* of the multiplier 31 as an input B2. The multiplier 31 carries out a multiplication of the input A2 by the input B2, upon application of each clock pulse CP6 thereto, to obtain a product of the Ti value corrected by the coefficient KTA and the other correction coefficient KTAV, which is outputted through the output terminal 31*c* and supplied to the Ti value register 32. The Ti value register 32 stores the Ti value data KTA×KTAV×Ti supplied from the multiplier 31, upon application of each clock pulse CP7 thereto, and supplies same to the Ti value control circuit 33. The Ti value control circuit 33 operates on the input Ti value data to generate a driving signal and applies same to the fuel injection valve or valves 6*a* to open same for a valve opening period of time corresponding to the input Ti value data.

FIG. 10 illustrates in detail the interior constructions of the KTA value determining circuit 22 and the KTAV value determining circuit 24, both shown in FIG. 8. According to this FIG. 10 arrangement, the determining circuits 22 and 24 are adapted to determine the values of coefficients KTA and KTAV by means of arithmetic calculation. The TA value register 21 in FIG. 8 has its output connected to the input of a memory 34 provided in the KTA value calculating circuit 22 and storing a plurality of predetermined temperature-indicative, as well as an input terminal 47*a* of a multiplier 47 and an input terminal 53*a* of a comparator 53, both incorporated within the KTAV value determining circuit 24. The memory 34 has its output connected to an input terminal 35*b* of a subtractor 35 which has another input terminal 35*a* connected to a TAO value memory 36. The subtractor 35 has its output terminal 35*c* connected to an input terminal 37*a* of a multiplier 37 which has another input terminal 37*b* connected to a CTA value memory 38. The multiplier 37 has its output terminal 37*c* connected to an input terminal 40*a* of an adder 40 by way of an A1 value register 39. A memory 41 storing a data value of 1 has its output connected to another input terminal 40*b* of the adder 40 as well as an input terminal 42*b* of a divider 42. The adder 40 has its output terminal 40*c* connected to an input terminal 42*a* of the divider 42 which has its output terminal 42*c* connected to the input terminal 30*b* of the multiplier 30 appearing in FIG. 8, by way of a KTA value register 43.

The output indicative of actual intake air temperature TA of the TA value register 21 in FIG. 8 is applied to the memory 34, and a temperature-indicative value corresponding to the input data is selectively read from the memory 34 and applied to the input terminal 35*b* of the subtractor 35 as an input M1. This subtractor 35 has its other input terminal 35*a* supplied as an input N1 with the data value which is a constant corresponding to a temperature value of 40° C., for instance, from the memory 36, to carry out a subtraction of the input M1 from the input N1. The resultant difference M1−N1 ($=TA-TAO$) is applied to the input terminal 37*a* of the multiplier 37 as an input A3. The CTA value memory 38, which stores a constant value CTA which is determined in dependence upon the engine associated with the present system, applies its stored constant value to the other input terminal 37*b* of the multiplier 37 as an input B3. In the multiplier 37, a multiplication of the input A3 by the input B3 is carried out upon application of each clock pulse CP1 to the multiplier 37, and the resultant product A3×B3, i.e. CTA(TA−TAO) is supplied to the A1 value register 39. The A1 value register 39 has its old stored value replaced by a new product A3×B3 upon application of each clock pulse CP2 thereto, and simultaneously the new stored value is applied to the input terminal 40*a* of the adder 40 as an input M2. The memory 41 applies its stored constant value of 1 to the input terminal 40*b* of the adder 40 as an input N2. The adder 40 carries out an addition of the input M2 and the input N2, and applies the resultant sum M2+N2 ($=1+CTA(TA-TAO)$) to the input terminal 42*a* of the divider 42 as an input D. The divider 42 has its other input terminal 42*b* supplied as an input C with a constant value of 1, from the memory 41. Thus, in the divider 42, a division of the input C by the input D is carried out upon application of each clock pulse CP3 to the divider 42, and the resultant quotient C/D $\{=1/[1+CTA(TA-TAO)]\}$ is supplied to the KTA value register 43. The KTA value register 43 has its old stored value replaced by a new quotient value C/D upon application of each clock pulse CP4 thereto, and simultaneously the new stored value, that is, a new value of the correction coefficient KTA thus calculated is supplied to the multiplier 30 in FIG. 8.

On the other hand, in the KTAV value determining circuit 24, the multiplier 47 has its input terminal 47*b* connected to a CTAV value memory 48, and its output terminal 47*c* connected to an input terminal 50*b* of a subtractor 50. The subtractor 50 has its input terminal 50*a* connected to a CTAVO value memory 51 and its output terminal 50c to one input terminal of an AND circuit 52, respectively. The AND circuit 52 has its output connected to the input of a KTAV value register 58 by way of an OR circuit 57. The KTAV value register 58 has its output connected to the input terminal 31b of the multiplier 31 in FIG. 8. The comparator 53 has its input terminal 53b connected to a TAX value memory 54, its one output terminal 53c to the other input terminal of the AND circuit 52, and its other output terminal 53d to one input terminal of an AND circuit 55, respectively. The AND circuit 55 has its other input terminal connected to a KTAVO value memory 56, and its output to the input of the OR circuit 57, respectively.

The CTAV value memory 48 and the CTAVO value memory 51 store a proportional constant CTAV and a constant CTAVO, respectively, which are used for calculation of the value of the correction coefficient applicable when the actual intake air temperature TA is lower than the reference temperature TAVO, shown in FIG. 7. These constants are experimentally determined so as to conform to the engine to which the present device is applied. The TAX value memory 54 stores the value of the reference intake air temperature TAVO (e.g. 10° C.), and the KTAV value memory 56 a constant value of 1.0, respectively.

The output indicative of actual intake air temperature TA of the TA value register 21 is applied as an input A4 to the input terminal 47a of the multiplier 47 which has its other input terminal 47b supplied as an input B4 with the proportional constant value CTAV from the CTAV value memory 48. The multiplier 47 carries out a multiplication of the input A4 by the input B4 upon application of each clock pulse CP1 thereto, and the resultant product A4×B4 or CTAV×TA is supplied to the A3 value register 49. The A3 value register 49 has its old stored value replaced by a new product value A4×B4 upon application of each clock pulse CP2 thereto, and simultaneously the new stored value is applied to the input terminal 50b of the subtracter 50 as an input N4. The subtracter 50 has its other input terminal 50a supplied as an input M4 with the constant value CTAVO from the CTAVO value memory 51. Thus, the subtracter 50 carries out a subtraction of the input N4 from the input M4, and supplies the resultant difference M4−N4 ($=CTAVO-CTAV\times TA$) to one input terminal of the AND circuit 52.

In the comparator 53, a comparison is made as to whether or not the actual intake temperature TA is higher than the reference temperature TAVO. More specifically, the actual intake air temperature value TA from the TA value register 21 is applied to the input terminal 53a of the comparator 53 as an input X1, and the reference temperature value TAVO from the TAX value memory 54 to the other input terminal 53b of same as an input Y1, respectively. When the input relationship of X1≦Y1 or TA≦TAVO stands, the comparator 53 supplies an output of 1 through its output terminal 53c to the AND circuit 52, and simultaneously an output of 0 through its other output terminal 53d to the AND circuit 55, respectively. Thus, the AND circuit 52 is opened, and simultaneously the AND circuit 55 is closed, and accordingly, the difference value M4−N4 is supplied to the KTAV value register 58 through the AND circuit 52 and the OR circuit 57.

When the input relationship of X1>Y1 or TA>TAVO stands, the comparator 53 generates an output of 0 at its output terminal 53c, and an output of 1 at its other output terminal 53d, respectively, in a manner reverse to that mentioned above. Thus, the AND circuit 52 is closed, and the AND circuit 55 is opened, and accordingly, the constant value of 1.0 from the KTAVO value memory 56 is supplied to the KTAV value register 58 through the AND circuit 55 and the OR circuit 57. The KTAV value register 58 has its old stored value replaced by a new input value upon application of each clock pulse CP3 thereto, and simultaneously the new stored value is applied to the input terminal 31b of the multiplier 31 in FIG. 8, which value is either (CTAVO−CTAV×TA) or 1.0, depending upon the actual intake air temperature TA.

Figures 11, 12:
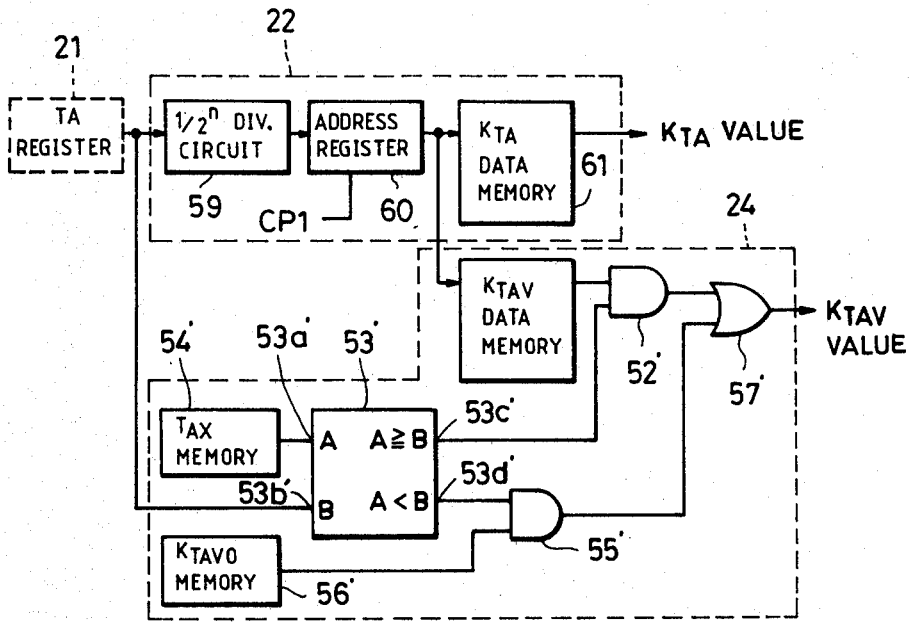
FIG. 11 is a circuit diagram illustrating another embodiment of the interior arrangements of the KTA value determining circuit and the KTAV value determining circuit.
FIG. 12 is a view showing a map of the intake air temperature TA and the intake air temperature-dependent correction coefficients KTA and KTAV.

FIG. 11 illustrates another embodiment of the KTA value determining circuit 22 and the KTAV value determining circuit 24. The TA value register 21 in FIG. 8 has its output connected to the input of a $\frac{1}{2}^n$ dividing circuit 59 incorporated in the KTA value determining circuit 22, and also to an input terminal 53b' of a comparator 53' incorporated in the KTAV value determining circuit 24. The $\frac{1}{2}^n$ dividing circuit 59 has its output connected to a KTA value data memory 61 and a KTAV value data memory 62 which is incorporated in the KTAV value determining circuit 24, by way of an address register 60. The KTA value data memory 61 has its output connected to the input terminal 30b of the multiplier 30 in FIG. 8, and the KTAV value data memory 62 has its output connected to one input terminal of an AND circuit 52'. The AND circuit 52' has its output connected to the input terminal 31b of the multiplier 31 in FIG. 8 by way of an OR circuit 57'. The comparator 53' has its input terminal 53a' connected to a TAX value memory 54', its one output terminal 53c' to the other input terminal of the AND circuit 52', and its other output terminal 53d' to one input terminal of the AND circuit 55', respectively. The AND circuit 55' has its other input terminal connected to a KTAVO value memory 56'. The address register 60 bears a plurality of addresses individually corresponding to different predetermined values of intake air temperature TA shown in FIG. 12 which shows a map of intake air temperature—correction coefficients KTA and KTAV, based upon the aforegiven equation (6) and the graph of FIG. 7. A plurality of predetermined values KTAi of the correction coefficient KTA individually corresponding to respective ones of the above addresses are stored in the KTA value data memory 61, and a plurality of predetermined values KTAVi individually corresponding to respective ones of the addresses in the KTAV value data memory 62, respectively. The actual intake air temperature value stored in the TA value register 21 is converted into an integral value by the $\frac{1}{2}^n$ dividing circuit 59, and the integral value is supplied to the address register 60. Upon application of each clock pulse CP1 to the address register 60, an address is read from the register 60, which corresponds to the input integral value, and the read address is applied to the KTA value data memory 61 and the KTAV value data memory 62. One of the predetermined values KTAi is read from the memory 61, which corresponds to the input address, and the read value KTAi is supplied to the multiplier 30 in FIG. 8. In a like manner, a value KTAVi corresponding to the input address is read from the memory 62, and the read value KTAVi is supplied to the AND circuit 52'.

The AND circuits 52' and 55', the OR circuit 57', the comparator 53', the TAX value memory 54' and the KTAVO value memory 56' operate in a manner similar to the AND circuits 52 and 55, the OR circuit 57, the comparator 53, the TAX value memory 54 and the KTAVO value memory 56 which appear in FIG. 10. Briefly, the comparator 53' determines whether or not the actual intake air temperature TA is higher than the reference value TAVO. When it is determined that the former is higher than the latter, it causes supply of the constant value of 1.0 stored in the KTAVO value memory 56' to the multiplier 31 in FIG. 8 through the AND circuit 55' and the OR circuit 57'. When it is determined that the actual intake air temperature TA is lower than the reference value TAVO, the comparator 53' causes a value KTAVi stored in the KTAV value data memory 62 and corresponding to the input address to be supplied to the multiplier 31 in FIG. 8 through the AND circuit 52' and the OR circuit 57'.

Although in the FIG. 11 arrangement, the address register 60 is arranged to also supply read addresses to the KTAV value determining circuit 24, alternatively the KTAV value determining circuit 24 may be provided with another $\frac{1}{2}^n$ dividing circuit and another address register for exclusive use. Further, the KTAV value data memory 62 may also be arranged to store a constant KTAV value (=1.0) applicable when the actual intake air temperature TA exceeds the reference value TAVO, and at the same time the same memory 62 may be directly connected to the input terminal **31*b* of the multiplier 31 in FIG. 8, while omitting the comparator 53', the TAX value memory 54', the KTAVO value memory 56', the AND circuits 52' and 55', and the OR circuit 57'**.

What is claimed is:

1. In a fuel supply control system for use with an internal combustion engine having an intake pipe, said system including means for determining a basic value of the air/fuel ratio of an air/fuel mixture being supplied to said engine, as a function of at least one parameter representing operating conditions of said engine, an air/fuel ratio correcting device comprising: a sensor for detecting a value of intake air temperature in said intake pipe of said engine; means for determining a value of a correction coefficient as a function of a value of the intake air temperature detected by said sensor; and means for correcting a basic value of the air/fuel ratio of said air/fuel mixture determined by said basic value determining means, by an amount corresponding to a value of said correction coefficient determined by said correction coefficient determining means; wherein said correction coefficient determining means is adapted to determine the value of said correction coefficient by the following equation:

$$KTA=1/[1+CTA(TA-TAO)]$$

where TA represents a detected value (°C.) of the intake air temperature, TAO a predetermined reference value (°C.) of the intake air temperature, and CTA a constant having a value thereof determined by said engine.

2. The air/fuel ratio correcting device as claimed in claim 1, further including means for determining a value of a second correction coefficient as a function of a value of the intake air temperature detected by said sensor, and means for further correcting the basic value of the air/fuel ratio of said air/fuel mixture determined by said basic value determining means, by an amount corresponding to a value of said second correction coefficient determined by said second correction coefficient determining means, said second correction coefficient determining means being adapted to determine the value of said second correction coefficient in a manner such that the determined value of said second correction coefficient has a predetermined constant value when the intake air temperature has a value higher than a predetermined value which is lower than said predetermined reference value TAO, and has a value thereof increasing as the intake air temperature has a value thereof decreasing from said predetermined value.

3. The air/fuel ratio correcting device as claimed in claim 2, wherein said predetermined value of the intake air temperature for said second correction coefficient is set at a value falling within a range of intake air temperature at which fuel injected into the intake pipe of the engine can be completely evaporated within a period of time between the injection of the fuel and ignition of same.

4. In a fuel supply control system for use with an internal combustion engine having an intake pipe and at least one electromagnetically controlled fuel injection valve arranged for injecting fuel into said engine and having a valve opening period thereof adapted to determine a quantity of fuel being supplied to said engine, said system including means for determining a basic value of the valve opening period of said fuel injection valve as a function of at least one parameter representing operating conditions of said engine, to thereby control the air/fuel ratio of an air/fuel mixture being supplied to said engine, an air/fuel ratio correcting device comprising: a sensor for detecting a value of intake air temperature in said intake pipe of said engine; means for arithmetically calculating a value of a correction coefficient as a function of a value of the intake air temperature detected by said sensor; and means for correcting a basic value of the air/fuel ratio of said air/fuel mixture determined by said basic value determining means, by an amount corresponding to a value of said correcting coefficient arithmetically calculated by said arithmetically calculating means; wherein said arithmetically calculating means is adapted to arithmetically calculate the value of said correction coefficient by the following equation:

$$KTA=1/[1+CTA(TA-TAO)]$$

where TA represents a detected value (°C.) of the intake air temperature, TAO a predetermined reference value (°C.) of the intake air temperature, and CTA a constant having a value thereof determined by said engine.

5. The air/fuel ratio correcting device as claimed in claim 4, further including means for arithmetically calculating a value of a second correction coefficient as a function of a value of the intake air temperature detected by said sensor, and means for correcting the basic value of the air/fuel ratio of said air/fuel mixture determined by said basic value determining means, by an amount corresponding to a value of said second correction coefficient arithmetically calculated by said second correction coefficient calculating means, said second correction coefficient correcting means being adapted to calculate the value of said second correction coefficient in a manner such that the calculated value of said second correction coefficient has a predetermined constant value when the intake air temperature has a value higher than a predetermined value which is lower than said predetermined reference value TAO, and has a value thereof increasing as the intake air temperature has a value thereof decreasing from said predetermined value.

6. In a fuel supply control system for use with an internal combustion engine having an intake pipe and at least one electromagnetically controlled fuel injection valve arranged for injecting fuel into said engine and having a valve opening period thereof adapted to determine a quantity of fuel being supplied to said engine, said system including means for determining a basic value of the valve opening period of said fuel injection valve as a function of at least one parameter representing operating conditions of said engine, to thereby control the air/fuel ratio of an air/fuel mixture being supplied to said engine, an air/fuel ratio correcting device comprising: a sensor for detecting a value of intake air temperature in said intake pipe of said engine; means storing a plurality of predetermined values of a correction coefficient given as a function of the intake air temperature; means for selectively reading one of said predetermined values from said storing means, which corresponds to a value of the intake air temperature detected by said sensor; and means for correcting a basic value of the valve opening period of said fuel injection valve determined by said basic value determining means, by an amount corresponding to a value of said correction coefficient read from storing means; wherein said predetermined values of said correction coefficient stored in said storing means are determined by the following equation:

$$KTA = 1/[1 + CTA(TA - TAO)]$$

where TA represents a detected value (°C.) of the intake air temperature, TAO a predetermined reference value (°C.) of the intake air temperature, and CTA a constant having a value thereof determined by said engine.

7. The air/fuel ratio correcting device as claimed in claim 6, further including means storing a plurality of predetermined values of a second correction coefficient given as a function of the intake air temperature, means for selectively reading one of said predetermined values from said second correction coefficient storing means, which corresponds to a value of the intake air temperature detected by said sensor, and means for further correcting the basic value of the valve opening period of said fuel injection valve, by an amount corresponding to a predetermined value read from said second correction coefficient storing means, said reading means being adapted to read from said second correction coefficient storing means in a manner such that the read value has a predetermined constant value when the intake air temperature has a value higher than a predetermined value which is lower than said predetermined reference value TAO, and has a value thereof increasing as the intake air temperature has a value thereof decreasing from said predetermined value.

* * * * *